United States Patent [19]

Kubik

[11] 4,060,022

[45] Nov. 29, 1977

[54] HYDRAULIC MOTOR HAVING POSITIVE LOCKING MEANS

[76] Inventor: Philip A. Kubik, 1527 Lochridge, Bloomfield Hills, Mich. 48013

[21] Appl. No.: 740,596

[22] Filed: Nov. 10, 1976

[51] Int. Cl.[2] ..... F15B 21/02

[52] U.S. Cl. ..... 91/40; 60/483; 91/44

[58] Field of Search ..... 60/483, 484; 91/35, 91/36, 44, 459, 490, 40

[56] References Cited

U.S. PATENT DOCUMENTS

| | | | |
|---|---|---|---|
| 3,036,557 | 5/1962 | Kimsey | 91/490 X |
| 3,759,042 | 9/1973 | Shioda et al. | 60/483 |

*Primary Examiner*—Edgar W. Geoghegan
*Attorney, Agent, or Firm*—Andrew R. Basile

[57] ABSTRACT

A hydraulic motor having a housing and a shaft journaled for rotation along the longitudinal axis of the housing. The shaft carries an eccentric on which is rotatably mounted a bearing block. The housing has a plurality of hydraulic cylinders grouped about the axis of the shaft in a common plane normal to the axis of rotation of the shaft with each cylinder having a hollow piston displaceable therein and biased in a direction toward the bearing block. The shaft and the eccentric have inlet and outlet passages communicating with the bearing block and adapted to communicate a source of hydraulic fluid pressure and an exhaust means respectively therewith. Means are provided on the eccentric for separating these passages from one another with the bearing block having a port communicating fluid from the aforementioned passages to the piston interior, whereby fluid pressure may be admitted to the cylinders in turn, one after another, during the operation of the motor to exert a direct thrust on the eccentric. Fluid communicated from the interior of the piston acts against the upper ends of the piston on an effective pressure responsive area which is isolatable from the source of fluid pressure such that upon the operation of selected valve means the effective pressure responsive area of the piston may be isolated to positively lock the piston in position and prevent rotation of the shaft.

12 Claims, 4 Drawing Figures

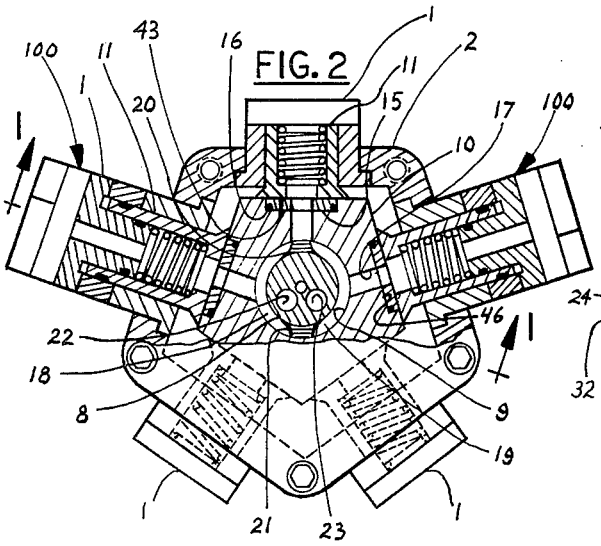
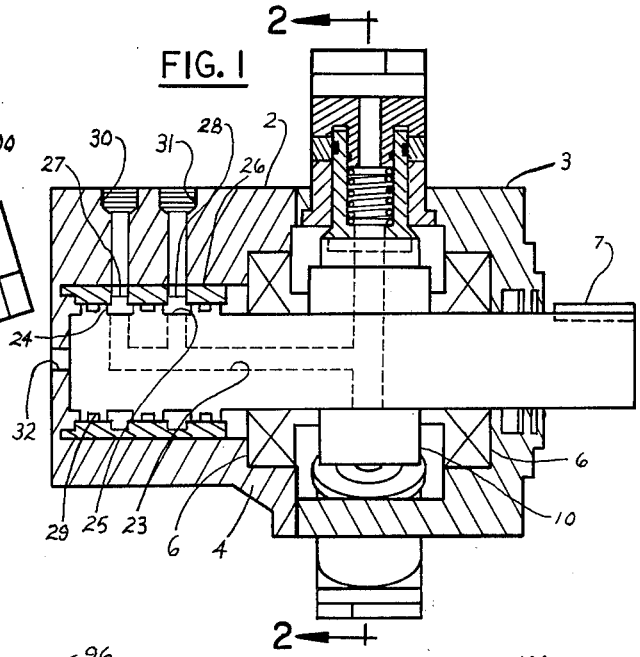
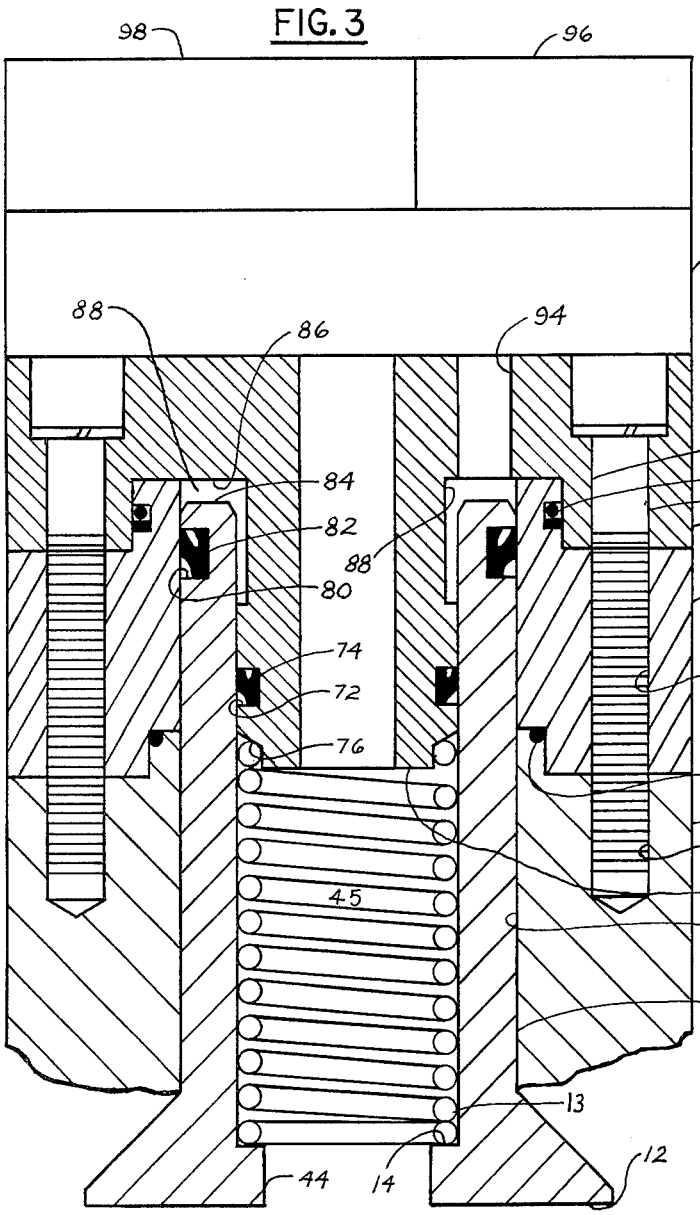
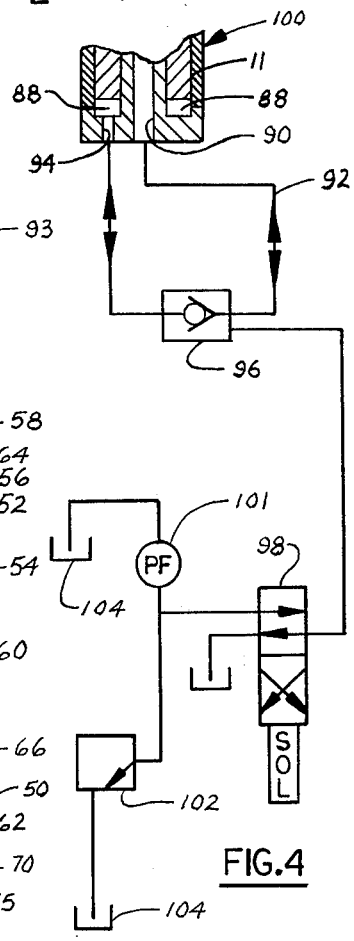
FIG. 4

HYDRAULIC MOTOR HAVING POSITIVE LOCKING MEANS

BACKGROUND OF THE INVENTION

I. Field of the Invention

The present invention relates to a power transmission and, in particular, to hydraulic motors wherein a means is provided for positively locking the output shaft of such hydraulic motors.

II. Description of the Prior Art

Hydraulic motors are known to comprise a casing having a plurality of hydraulic cylinders grouped about a floating bearing block and a shaft journaled in the housing and wherein an eccentric working in a cylindrical bore of the bearing block is provided. Hydraulic cylinders are arranged to receive fluid under pressure from the bearing block imparting to the bearing block a circular motion which results in the rotation of the eccentric and motor shaft on which the eccentric is carried. It would be desirable to have such a motor wherein it is possible to rotate the output shaft over selected distances and then lock the rotating shaft against further movement. To the knowledge of the inventor, no such prior art structure has been constructed which functions in an acceptable and workable manner as applicant's instant disclosure.

SUMMARY OF THE INVENTION

The present invention, which will be described subsequently in greater detail, comprises a hydraulic motor having a housing and a shaft journaled in said housing for rotation about the longitudinal axis of the housing. An eccentric is mounted on the shaft and carries a bearing block such that the bearing block rotates relative to the eccentric. A plurality of hydraulic cylinders are grouped about the axis of the shaft in a common plane normal to the axis with each of the cylinders mounting a hollow piston that is displaceable therewithin. The pistons are spring biased into a sliding sealing engagement with the bearing blocks. Suitable fluid pressure passages are provided for communicating fluid under pressure from the bearing block to the interior of the piston. Means within each of the cylinders is provided to isolate the effective pressure responsive areas of the displaceable piston from the source of fluid pressure, such that the effective pressure responsive areas may be isolated from the source of pressure to prevent retraction of the piston and thereby prevent rotation of the eccentric. In this mode the shaft is positively locked after the shaft is moved the desired annular distance.

It is therefore an object of the present invention to provide a new and improved hydraulic motor having means for positively locking the output shaft at selected annular locations.

It is a further object of the present invention to provide a positive locking feature for the aforementioned motors which is simple in design and construction and one which may be incorporated into existing motors, as well as utilized in new models.

Other objects, advantages and applications of the present invention will become apparent to those skilled in the art of manufacturing hydraulic motors when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like parts throughout the several views, and wherein:

FIG. 1 is a longitudinal sectional view of a hydraulic motor constructed in accordance with the principles of the present invention, the section being taken along Line 1—1 of FIG. 2;

FIG. 2 is a partial transverse sectional view of the hydraulic motor taken along Line 2—2 of FIG. 1;

FIG. 3 is a fragmentary enlarged cross-sectional view of one of the cylinder and piston assemblies illustrated in FIGS. 1 and 2 of the drawings; and FIG. 4 is a schematic illustration of one example of a hydraulic circuit which may be employed in the operation of the positive locking means utilized in the present invention motor for preventing rotation of the output shaft.

DESCRIPTION OF THE PREFERRED EMBODIMENT

Referring now to the drawing and, in particular, to FIGS. 1 and 2 wherein there is illustrated one example of the present invention in the form of a hydraulic motor of the floating bearing block type. The motor has five hydraulic cylinders 1 grouped about the axis of the motor shaft 7 in a common plane normal to this axis (which plane is hereinafter referred to as the "main cross plane" of the motor). The cylinders 1 are held in place in a motor housing 2 having substantially the form of a pentagon in an end view (FIG. 2), the housing presenting two hubs 3 and 4 mounting bearings 6 for the shaft 7. The shaft 7 has an eccentric 8 in line with the cylinders 1 and arranged to rotate in the cylinder bore 9 of a bearing block 10 which, in turn, is in the form of a regular pentagon in end view (FIG. 2), but with its center coincident with the axis of eccentricity of the eccentric 8.

A hollow flat-ended piston 11 (FIG. 3) is slideable in each hydraulic cylinder 1. The end face 12 of each piston 11 is constrained into a sealing contact with one of the faces of the pentagon bearing block 10 by means of a coil spring 13 pressing at its outer end on the head of the cylinder 1, as will be explained hereinafter in greater detail, and at its inner end on an internal shoulder 14 of the piston 11. A centrally disposed opening 44 in the end face 12 of each piston 11 communicates with and is coaxial with the hollow interior or chamber 45 of the piston 11. A pressure retaining ring 15 (FIG. 2) for each piston 11 is incorporated in the bearing block 10, and a centrally disposed opening 46 in the ring 15 is coaxial with the opening 44 in the end face 12 of the piston 11 when the latter is retracted from the cylinder 1 as the piston 11 is shown at the 12 o'clock position in FIG. 1. Each pressure retaining ring 15 has an effective area not greater than that of the cylinder bore and is allowed to float to a limited degree of the order of a few thousandths of an inch in a recess of the pentagon bearing block 10, sealing between the floating bearing block and the pressure retaining ring being achieved by a suitable seal 16. Suitable means 43 hold the pressure retaining ring 15 in position in the recess but do not interfere with the aforementioned limited floating action.

Five radial ports 17 situated in the aforementioned main cross plane extend from the cylinder bore 9 of the pentagon bearing block 10, one to each of the five faces of the block and therefore to the interior of the pertaining hydraulic cylinder 1. In the same main cross plane the periphery of the eccentric 8 on the motor shaft 7 is formed with two oppositely situated arcuate grooves 18 and 19 (FIG. 2), separated from one another at both ends by lands 20 and 21 which constitute in effect a valve means that covers and uncovers the aforesaid radial ports 17 as the eccentric 8 and the motor shaft 7 rotate. Two ducts 22 and 23 extend along the motor shaft 7 parallel to the shaft axis, and these ducts communicate at one end, each with one of the aforementioned arcuate grooves 18 or 19 in the eccentric 8; and at the other end of each of the ducts 22 and 23, each duct communicates with one of two annuli 24 and 25 formed adjacent one another in the motor shaft 7. A sleeve 26 surrounds this end portion of the motor shaft 7 within one of the hubs of the motor housing. This sleeve has a number of radial ports 27 and 28 which allow hydraulic fluid to pass from a circular portion in the hub 4 to the annuli 24 and 25. Suitable resilient seals 29 are fitted around the periphery of the sleeve so as to take up any misalignment or wear that may occur. Two radial openings 30 and 31 extend from the casing hub 4, one to each reduced portion of the sleeve 26, and these openings are screw threaded for connection to a suitable conduit.

The interior of the motor casing communicates with a radial port adjacent the eccentric and an axial port in the motor shaft to a drain connection 32 in an end closure for one of the casing hubs.

Referring now to FIG. 3 for an aid in understanding the detailed description of two alternately spaced cylinders 100. Each cylinder 100 comprises a tubular body portion 50 enclosed at its upper end by a T-shaped end cap or head 52 and a cylindrical mid-section 54 which is sandwiched between the body 50 and the end cap 52 by means of longitudinally disposed bolts 56 that extend through suitable through bores 58 and 60 in the end cap 52 and cylindrical mid-section 54, respectively, into threaded engagement with threaded bore 62. O-ring type seals 64 and 66 are strategically located at the inner face between the end cap 52, the mid-section 54, and the body 50 to provide a fluid-tight relationship between the several parts. The interior cylindrical surfaces of the body 50 and mid-section 54 define a longitudinal bore 55 which slideably and displaceably receives the hollow piston 11, as aforementioned. The hollow interior or chamber 45 of the piston 11 slideably receives the projecting leg 70 formed on the bottom of the head 52. A recess 72, formed on the outer periphery of the leg 70, accommodates a suitable seal 74 which slideably engages the internal wall surface of the piston 11 to prevent the passage of fluid thereby. As can best be seen in FIG. 3, the spring 13 abuts the end of the leg 70 in a suitably formed shoulder 76 and exerts a bias against the piston 11 so as to urge it into abutment with the pentagon bearing block 10, as aforementioned. The upper peripheral section of the piston 11 is provided with a recess 80 which mounts a ring seal 82 that slideably engages the wall of the bore 55 of the mid-section 54 to form a fluid-tight seal thereinbetween.

The annular section defined between the upper end 84 and the opposing inner surface 86 of the head 52 defines a pressure chamber 88 into which fluid is communicated and acts against the effective pressure responsive surface 84 of the piston 11 so as to urge the piston 11 into an abutting engagement with the bearing block 10 in the manner to be described hereinafter. Fluid pressure is communicated to the pressure chamber 88 from the piston chamber 45 by means of a longitudinal passageway 90 extending completely through the leg 70 of the head 52. The passageway 90 communicates (via a passageway 92 in a manifold 93) with a check valve 96 and a passageway 94 extending through the head 52. Passageway 94, in turn, communicates with the pressure chamber 88. The pilot-operated check valve 96 normally permits fluid under pressure to flow through the piston interior 45 and the bore 90 of the leg 70 and into the pressure chamber 88 to exert a force against the effective pressure responsive surface 84 of the piston 11 so as to move the piston outwardly from the cylinder 1 towards the bearing block 10. The fluid within the chamber 88 is forced outwardly through the passageway 92 and the check valve 96 and back into the interior of the piston 11 when the piston 11 is retracted into the cylinder 1 in the manner to be described. In order for this to be accomplished, it is necessary for the pilot-operated check valve 96 to be opened, otherwise the column of fluid within the pressure chamber 88 will prevent retraction of the piston 11 within the cylinder 1. The power-operated check valve 96 is operated by means of a solenoid-operated directional control valve 98 which selectively communicates fluid pressure from a fixed displacement pump 101 to the pilot valve 96 to open the same. When it is desired that the valve 96 permit flow only in one direction, that is, from the passageway 90 to the pressure chamber 88 but not from the pressure chamber 88 to the passageway 90, the power-operated check valve 96 is in the position illustrated in FIG. 4; and fluid from the pump 101 is blocked from communicating with the check valve 96. The fluid from the pump 101 may be utilized for other control pressure applications in the motor, or it may just be dumped over a pressure relief valve 102 and back to the reservoir 104, as a particular application may require. The check valve 96 and directional control valve 98 are both mounted on top of the manifold 93.

In the preferred embodiment each rotational position, in which it is desired to positively lock the rotation of the shaft 7, will be provided with the positive locking assembly of the type illustrated in FIG. 3. All the cylinders 1 may be provided with such a positive locking assembly, and each assembly will be provided with one pilot-operated check valve 96. In the preferred embodiment only two cylinders 100 have locking pistons. All of the check valves 96 may be operated by one solenoid-operated directional control valve 98, or in the preferred embodiment each individual pilot-operated check valve 96 associated with each positive locking assembly of each cylinder 100 is provided with a directional control valve 98. In this arrangement each cylinder 1 and its associated locking mechanism may be individually operated. The non-locking cylinders have the pressure chambers 45 and 88 in continuous communication.

Assuming the port 31 to be functioning as the inlet port, the inflowing oil flows along a duct 22 into the arcuate groove 18. The oil then flows through the port 17, the opening 46 in the pressure retaining rings 15, and the openings 44 in the inner end face 12 of the hollow pistons 11 and into the piston hollow chamber 45, the openings 46 and 44 being in continuity with one another and with the piston interior or chamber 45. Oil then flows through the passageway 90 of the legs 70 through passageway 92, pilot-operated check valve 96, and passageway 94 to the pressure chamber 88 in the head of the cylinder 100. The volume of oil in the pressure chamber 88 acts on the effective pressure responsive area 84 of the piston 11, exerting a downward thrust against the piston 11, causing the shaft 7 to rotate. As the motor shaft 7 rotates, the land 20 closes and opens the port 17 allowing oil to enter or exhaust from the cylinders 1. The exhaust flow is from the pressure chamber 88, cylinder head passageway 94, pilot-operated check valve 96 (which has been actuated to open by means of communicating pressure fluid from the pump 101 via solenoid-operated directional control valve 98), passageway 92, head passageway 90, chamber 45 of the piston 11, through the openings 44 and 46, into the arcuate groove 19, along the duct 23, and exhausted through the port 30. It can be seen that by maintaining the solenoid-operated directional control valve 98 in a deactivated condition, the pilot-operated check valve 96 will prevent fluid from leaving the pressure chamber 88 and in such a mode that the piston associated with the cylinder whose check valve 96 is closed will prevent the column of oil from within the pressure chamber 88 from being exhausted, whereby the piston 11 associated with this cylinder head will not be retractable within the cylinder 100; and as can be seen from FIG. 2, when the piston is not retractable, the bearing block 10 is not displaceable, and thus the shaft 7 will not rotate.

While only one example of the present invention has been disclosed, it should be apparent to those skilled in the art of hydraulic motors and similar apparatuses that other forms of applicant's invention may be had, all coming within the spirit of the invention and the scope of the appended claims.

What is claimed is as follows:

1. A hydraulic motor comprising:

a housing;

a shaft rotatably mounted within said housing;

an eccentric carried by said shaft;

a bearing block carried by said eccentric for relative rotation between said bearing block and said eccentric;

a plurality of hydraulic cylinders grouped about the axis of said shaft in a common plane normal to said axis;

a plurality of pistons each having a passage means, one piston being slideably mounted in each of said cylinders;

means urging each of said pistons in the direction of said bearing block, said cylinder and said piston defining thereinbetween an enclosed pressure chamber when communicated with a source of fluid, generates a force on said piston to extend said piston from said cylinder toward said bearing block and, when closed, said pressure chamber defining a volume fluid which prevents said piston from retracting into said cylinder to prevent said shaft from rotating; said shaft and eccentric having supply and exhaust passages communicating with said bearing block and adapted for connection to a source of fluid pressure and an exhaust means, respectively, and means disposed between said piston and said bearing block for admitting fluid pressure to said pistons in turn, one after the other, during the operation of said motor such that said pistons exert direct thrust on the eccentric to cause rotation of said shaft;

valve means normally operable to permit flow of pressure fluid from said piston to said pressure chamber, said valve means being operable upon actuation to close said fluid communication and block the flow of fluid from said pressure chamber; and means for operating said valve means.

2. The motor defined in claim 1 wherein said valve means comprises pilot-operated check valve connecting said piston passage means to said pressure chamber and normally operable to permit flow of fluid from said piston passage means to said pressure chamber and normally operable to prevent the flow of fluid from said pressure chamber to said piston passage means.

3. The motor defined in claim 2 further comprising a second source of pressure; directional control means for selectively communicating said source of pressure to said pilot-operated means to actuate said pilot-operated valve to open same and permit the flow of fluid from said pressure chamber to said piston passage means.

4. The motor defined in claim 1 wherein each of said cylinders has a pressure chamber, and each of said pistons has a passage means; each of said passage means and pressure chambers of said cylinders being connected through a conduit, and said conduits each having a pilot-operated check valve for preventing the flow of fluid from said pressure chamber to said piston passage means, and means selectively operable to actuate said pilot-operated check valve means to permit the flow of fluid from said pressure chamber to said pressure passageway of said piston.

5. The motor defined in claim 4 wherein said last-mentioned means comprises:

a source of fluid pressure; and a directional control valve for simultaneously communicating said source of pressure to each of said directional control valves for operating simultaneously said pilot-operated valves.

6. The motor defined in claim 4 wherein said means for operating said pilot-operated valves comprises:

a source of fluid pressure; and a plurality of directional control valves, one of each of said directional control valves being associated with one of said pilot-operated valves, each of said directional control valves being operable upon actuation for communicating said source of pressure to its associated pilot-operated check valve for selectively opening said associated valve to permit the flow of fluid from its associated pressure chamber to its associated piston passage means.

7. A hydraulic motor comprising:

a housing;

a shaft rotatably mounted within said housing;

a plurality of hydraulic cylinders grouped about the axis of said shaft in a common plane normal to said axis;

a plurality of pistons each having a passage means, one piston being slideably mounted in each of said cylinders;

means coupling said pistons to said shaft such that said shaft rotates as said pistons slideably move in said cylinders, said cylinder and said piston defining thereinbetween an enclosed pressure chamber when communicating with a source of fluid, generates a force on said piston to extend said piston from said cylinder toward said shaft and, when closed, said pressure chamber defining a volume of fluid which prevents said piston from retracting into said cylinder to prevent said shaft from rotating;

valve means normally operable to permit flow of pressure fluid from said piston to said pressure chamber, said valve means being operable upon actuation to close said fluid communication and block the flow of fluid from said pressure chamber; and means for operating said valve means.

8. The motor defined in claim 7 wherein said valve means comprises a pilot-operated check valve connecting said piston passage means to said pressure chamber and normally operable to permit flow of fluid from said piston passage means to said pressure chamber and normally operable to prevent the flow of fluid from said pressure chamber to said piston passage means.

9. The motor defined in claim 8 further comprising a second source of pressure; directional control means for selectively communicating said source of pressure to said pilot-operated means to actuate said pilot-operated valve to open same and permit the flow of fluid from said pressure chamber to said piston passage means.

10. The motor defined in claim 7 wherein each of said cylinders has a pressure chamber, and each of said pistons has a passage means; each of said passage means and pressure chambers of said cylinders being connected through a conduit, and said conduits each having a pilot-operated check valve for preventing the flow of fluid from said pressure chamber to said piston passage means, and means selectively operable to actuate said pilot-operated check valve means to permit the flow of fluid from said pressure chamber to said pressure passageway of said piston.

11. The motor defined in claim 10 wherein said last-mentioned means comprises:

a source of fluid pressure; and a directional control valve for simultaneously communicating said source of pressure to each of said directional control valves for operating simultaneously said pilot-operated valves.

12. The motor defined in claim 10 wherein said means for operating said pilot-operated valves comprises:

a source of fluid pressure; and a plurality of directional control valves, one of each of said directional control valves being associated with one of said pilot-operated valves, each of said directional control valves being operable upon actuation for communicating said source of pressure to its associated pilot-operated check valve for selectively opening said associated valve to permit the flow of fluid from its associated pressure chamber to its associated piston passage means.

* * * * *